United States Patent [19]

Grove

[11] 4,018,976

[45] Apr. 19, 1977

[54] KICKLESS RESISTANCE WELDING CABLE AND METHOD OF MAKING THE SAME

[76] Inventor: Earl I. Grove, 7220 Muerdale, West Bloomfield, Mich. 48033

[22] Filed: Apr. 15, 1976

[21] Appl. No.: 670,186

[52] U.S. Cl. ..... 174/19; 174/15 WF
[51] Int. Cl.[2] ..... H01B 7/34
[58] Field of Search ..... 174/19, 15 C, 15 WF, 174/27

[56] References Cited

UNITED STATES PATENTS

| | | | |
|---|---|---|---|
| 2,256,027 | 9/1941 | Jardine et al. | 174/15 WF |
| 2,504,777 | 4/1950 | Wreford | 174/15 WF |
| 2,702,311 | 2/1955 | Botterill et al. | 174/15 WF X |
| 2,879,317 | 3/1959 | Wreford | 174/15 WF |
| 3,127,467 | 3/1964 | Toto | 174/15 WF |
| 3,340,346 | 9/1967 | Toto | 174/15 WF |
| 3,363,047 | 1/1968 | Grove | 174/15 WF |
| 3,456,064 | 7/1969 | Toto | 174/15 WF |
| 3,467,767 | 9/1969 | Toto | 174/15 WF |
| 3,601,520 | 8/1971 | Carasso | 174/15 WF |

FOREIGN PATENTS OR APPLICATIONS

| | | | |
|---|---|---|---|
| 958,431 | 5/1964 | United Kingdom | 174/15 WF |

*Primary Examiner*—Arthur T. Grimley
*Attorney, Agent, or Firm*—Willis Bugbee

[57] ABSTRACT

This kickless water-cooled resistance welding cable consists of an elongated elastomeric hose containing two pairs of stranded copper wire conductors or "ropes" of opposite alternating polarities mounted in the four peripheral grooves of an elongated elastomeric separator of cruciform cross-section with a central cooling water passageway therethrough. These grooves are of circular cross-section such that when the separator is twisted longitudinally the groove side walls compress and tightly grip the conductors while these are cooled by water flowing into the grooves through perforations from the passageway. The conductors are connected at their opposite ends to copper terminals, each of which includes a pair of elongated semi-cylindrical copper terminal halves with an insulating strip between them and with two pairs of circumferentially-spaced bosses containing cable conductor sockets arranged in alternating polarity. Each terminal half consists of an elongated semi-cylindrical copper body with a recess in one end thereof, and a copper cable conductor adapter including a pair of the bosses and an integral tongue which is copper-welded into the body recess. The ends of the four cable conductors are copper-welded against the sides and bottoms of the sockets, which are of sector-shaped cross-section to receive the correspondingly sector-shaped ends of the cable conductors and V-notched to facilitate the flow of the molten welding copper to the surfaces being joined thereby.

10 Claims, 10 Drawing Figures

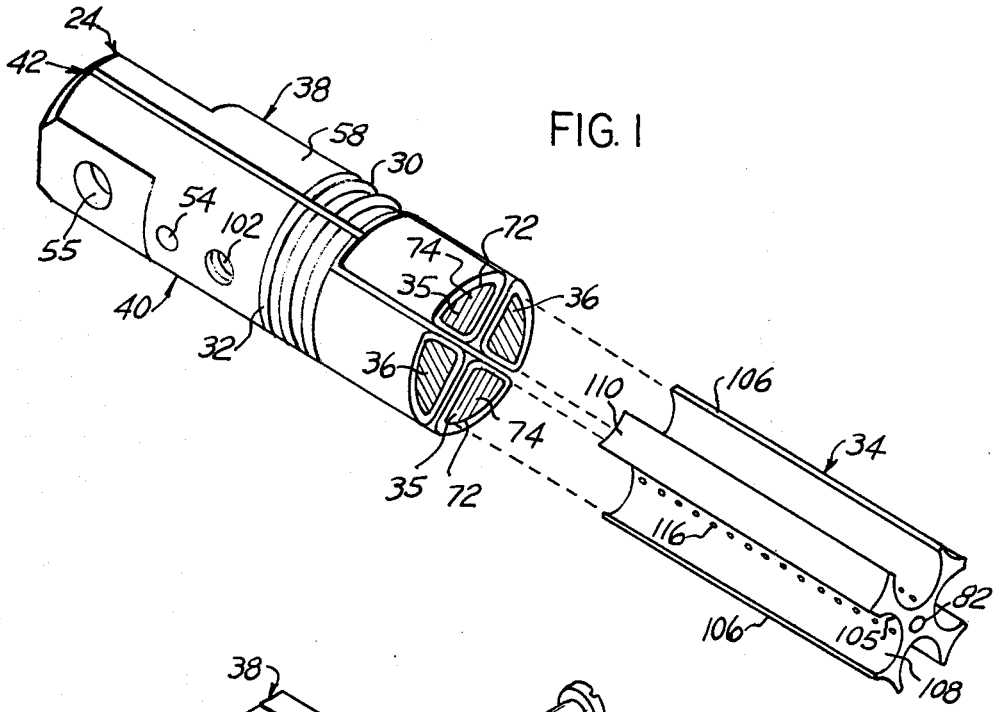
FIG. 1
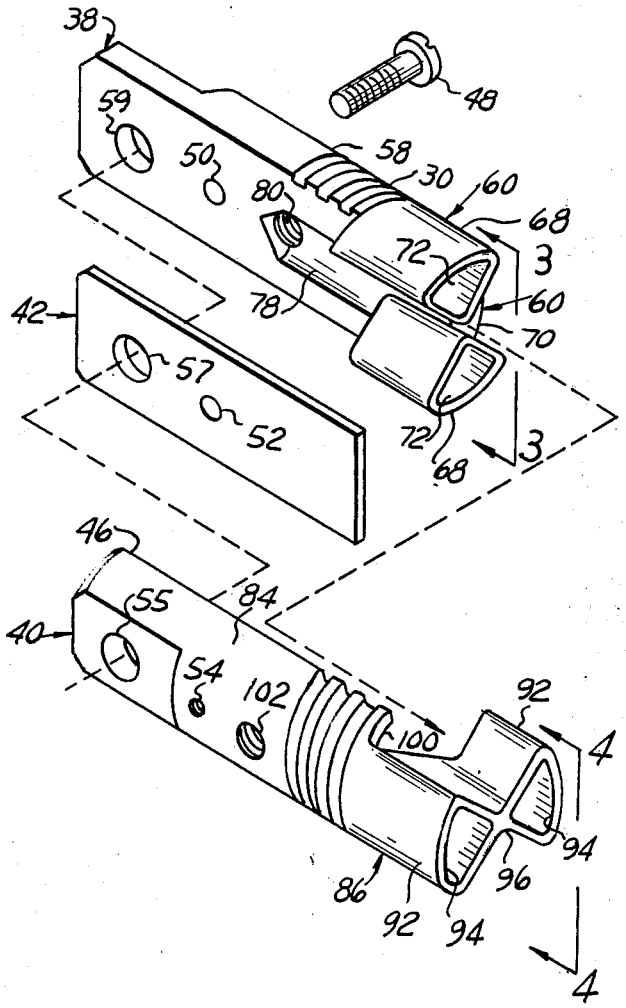
FIG. 2
FIG. 3
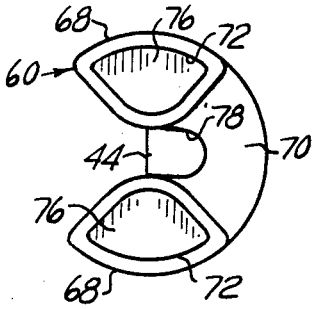
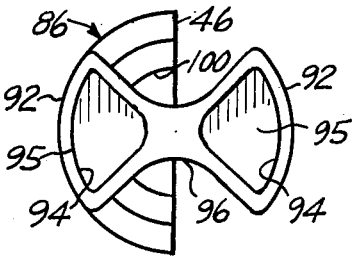
FIG. 4

FIG. 9
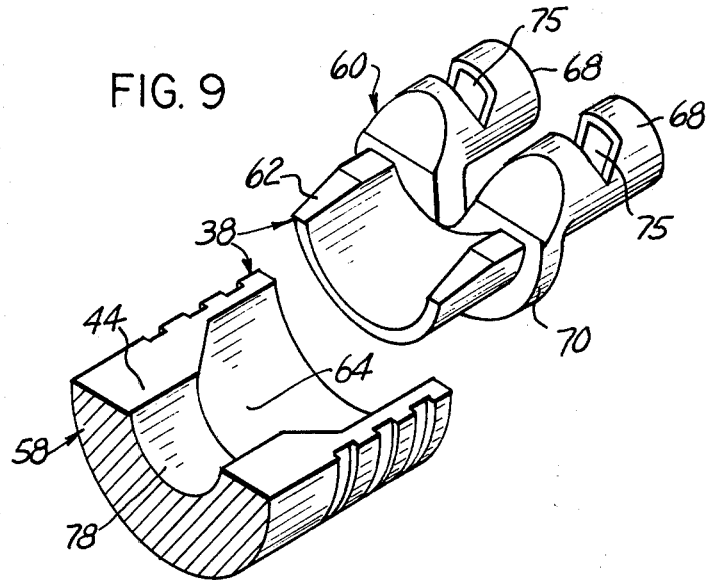
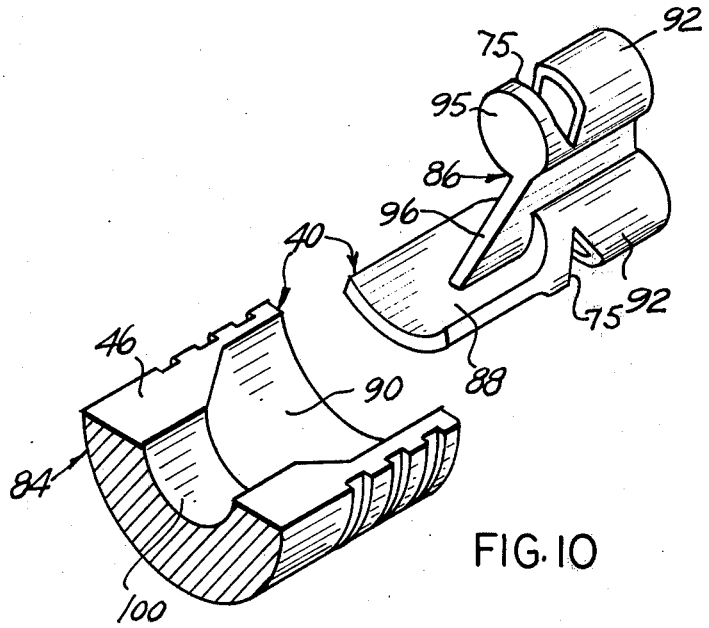
FIG. 10

KICKLESS RESISTANCE WELDING CABLE AND METHOD OF MAKING THE SAME

BACKGROUND OF THE INVENTION

Hitherto, multi-conductor kickless resistance welding cables have employed multi-part cable terminals at their opposite ends wherein the separate parts of each terminal half have been secured to one another by the use of solder, either soft solder or silver solder. Moreover, the ends of the individual cable ropes have likewise been secured by solder in their respective sockets. Experience has proved, however, that such solder-joining of the terminal parts to one another and of the cable ropes in the terminal sockets have resulted in imperfect junctions giving rise to high resistance losses at such junctions. The cutting of such terminals into sections at their respective pockets has shown that gaps frequently exist between the butt ends of the cable ropes and the bottoms of the sockets, further increasing the resistance encountered by the current, which thereupon has to flow through the thin side walls of the sockets on its way to the cable ropes.

The present invention reduces this resistance to a minimum by providing solid copper-welded gapless junctions, not only between the separate parts of each terminal half, but also solid copper-welded butt contacts between the ends of the copper cable ropes and the bottoms of the sockets. In this manner, solid uninterrupted paths of copper extend from end to end of the cable and its terminals with a maximum flow of current obtained therethrough.

An improved separator of elastomeric material and of roughly Maltese Cross configuration, when twisted longitudinally, causes its spiral grooves of circularly-arcuate cross-section to compress and grip the cable ropes tightly while, at the same time, permits cooling water to flow through the strands thereof from a central longitudinal channel through perforations in the walls of the hollow core of the separator.

SUMMARY OF THE INVENTION

The invention particularly resides in the copper welded junctions, not only between the parts of the copper terminal halves, but also in the copper welded junctions between the ends of the copper cable ropes and the bottoms of their respective sockets in the bosses of their terminal halves. It also resides in the elastomeric separator of roughly Maltese cross configuration having a hollow core with perforations which conduct cooling water therefrom into the four grooves which become spiral to tightly grip the conductor ropes when the separator is twisted lengthwise.

In the drawings,

FIG. 1 is an isometric view of one end of a kickless welding cable with copper-welded components showing in cross-section the ends of the cable ropes copper-welded in the sockets of their respective terminal bosses and with a portion of the cable conductor rope separator, with dotted lines indicating the continuations of the cable ropes therethrough but with the elastomeric cable hose omitted;

FIG. 2 is an exploded isometric view of the welding cable terminal of FIG. 1 with its component parts separated along the broken dotted lines, but with its cable ropes and separator omitted;

FIG. 3 is an end elevation upon an enlarged scale looking in the direction of the arrows 3—3 in FIG. 2;

FIG. 4 is an end elevation upon an enlarged scale looking in the direction of the arrows 4—4 in FIG. 2;

FIG. 9 is an exploded fragmentary isometric view of one cable rope adapter in its position above the one terminal body recess into which its tongue is about to be copper-welded; and FIG. 10 is an exploded fragmentary isometric view of the other cable rope adapter in its position above the other terminal body recess into which its tongue is about to be copper-welded.

GENERAL CONSTRUCTION

Figure 6:
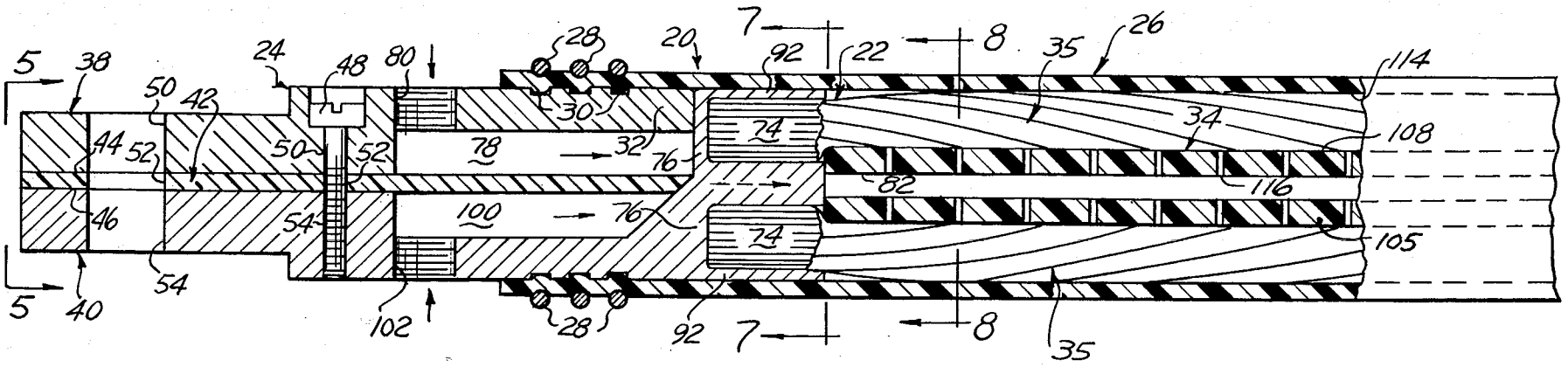
FIG. 6 is a central horizontal section through the welding cable of FIG. 1, taken along line 6—6 in FIG. 5.
Figure 7:
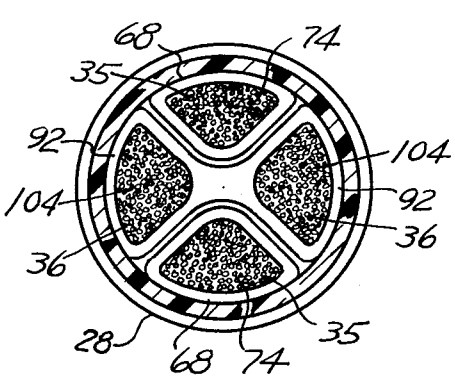
FIG. 7 is a cross-section, taken along the line 7—7 in FIG. 6.
Figure 5:
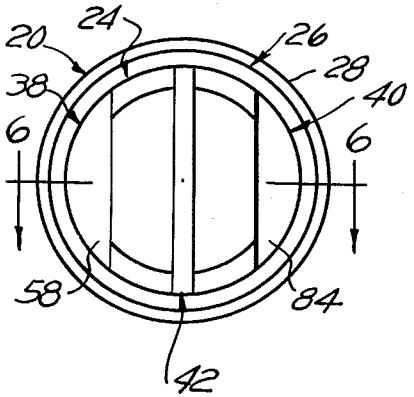
FIG. 5 is an end elevation of the welding cable shown in FIG. 1, looking in the direction of the arrows 5—5 in FIG. 6.

Referring to the drawings in detail, FIGS. 1 and 5 to 8 inclusive show a kickless resistance welding cable, generally designated 20, according to a preferred form of the invention as consisting of a stranded copper wire cable conductor unit 22 connected at its opposite ends to two copper terminals 24 of identical construction, only one of which is shown in the drawings. The cable conductor unit 22 is wholly surrounded and the inner ends of the terminals 24 partly surrounded by an elastomeric casing or hose 26 which is joined to the inner ends of the terminals 24 by clamping rings 28 which constrict the ends of the casing 26 into annular grooves 30 in the inner end portions 32 of the terminals 24. The cable conductor unit 22 consists generally of a longitudinally-grooved perforated tubular separator 34 of cross-shaped configuration extending lengthwise thereof and containing and separating two pairs of cable conductors or ropes 35 and 36 of stranded hair-like copper wires which possess opposite polarities during operation of the cable 20. The term "ropes" for the cable conductors 35 and 36 results from their resemblance to the arrangement of the fibrous twisted strands in a hemp rope.

TERMINAL CONSTRUCTION

Each of the two terminals 24 at the opposite ends of the cable 20 consists of a pair of copper terminal halves 38 and 40 separated from one another by an insulating strip 42 of rubber, plastic or other suitable electrically insulating material. These terminal halves are joined together along their flat inner surfaces 44 and 46 (FIG. 6) by a bolt or other suitable fastener 48 (FIGS. 1 and 2) extending through coaxial holes 50 and 52 into a threaded hole 54. A bolt (not shown) passes through coaxial holes 55, 57 and 59 to secure the terminal 24 to a transformer or welding gun (not shown). The cable halves 38 and 40, for convenience of manufacture, are formed in two separate portions copper-welded together, as described in more detail below, to make integral units thereof.

Figure 8:
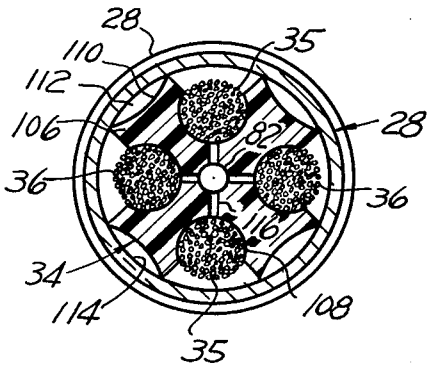
FIG. 8 is a cross-section, taken along the line 8—8 in FIG. 6.

In particular, the cable terminal half 38 is composed of an elongated semi-cylindrical terminal half body 58 (FIGS. 1, 2, 3 and 8) to which is joined a cable rope adapter 60 by a tongue 62 thereon of arcuate cross-section copper-welded into a body recess 64 likewise of arcuate cross-section. The cable rope adapter 60 has a pair of cable rope bosses 68 joined to and integral with the tongue 62 and interconnected by the adapter end wall 70 (FIGS. 2, 3 and 8). The bosses 68 contain sockets 72 of sector-shaped cross-section for receiving the correspondingly-shaped end portions 74 of the cable ropes 35. The center line passing through the sockets 72 is parallel to and preferably coincident with the flat inner surface 44 of the terminal half 38 (FIGS. 2 and 3). The end portions 74 of the cable ropes 35 are copper welded into the sockets 72 against the bottoms 76 of the sockets 72. The bosses 68 in their outer walls have V-notches 75 to provide across for the molten welding copper to the bottoms 76 and sides of the sockets 72 and the end portions 74 of the cable ropes 35, and become filled up with the welding copper upon welding. A cooling water channel or groove 78 extends from a transverse cooling water port 80 (FIG. 2) lengthwise of the terminal half 38 and between the bosses 68 to the adjacent end of the separator 34 and in line with the central passageway 82 therethrough (FIG. 6). In this manner, by the copper-welding procedure above mentioned, the terminal half body 58 of the terminal half 38, its adapter 60 and the copper conductor ropes 35 thus secured therein become an uninterrupted mass of copper from one end of the cable 20 to the other end thereof.

In a similar manner (FIGS. 1, 2, 4 and 9), the terminal half 40 is composed of an elongated semi-cylindrical terminal half body 84 to which is joined a cable rope adapter 86 by a tongue 88 thereon of arcuate cross-section copper-welded into a body recess 90, likewise of arcuate cross-section. The cable rope adapter 86 (FIGS. 2 and 4) likewise has a pair of cable rope bosses 92 containing sockets 94 with bottoms 95 joined to and integral with the tongue 88 and interconnected by a web 96 (FIGS. 2, 4 and 9). The flat inner surface 46 of the base 84 of the terminal half 40, in contrast to the terminal half 38, is disposed perpendicular to the center line passing through the sector-shaped sockets 94 in the bosses 92 (FIG. 4). A cooling water channel or groove 100 comparable to the cooling water channel or groove 78 of the terminal half 38 passes lengthwise along the inner surface 46 of the body 84 from a cooling water port 102 (FIG. 2) and terminates adjacent the outer end of the web 96 so that the cooling water flows on opposite sides of the web 96 into the central passageway 82 in the separator 34. The end portions 104 of the cable ropes 36 are copper-welded into the sockets 94 of the bosses 92 of the adapter 86 against the bottoms 95 thereof in a manner similar to that described above for the end portions 74 of the cable ropes 35 in their respective sockets 72, and also resulting in an uninterrupted mass of copper from one end of the cable 20 to the other end thereof.

SEPARATOR CONSTRUCTION

The elastomeric separator 34 (FIGS. 1 and 8), as stated above, is of roughly Maltese cross-shaped configuration with a hollow core 105 from which four ribs 106 radiate. The ribs 106 are approximately T-shaped and are separated from one another by grooves 108 of circularly-arcuate cross-sections which are greater than a semi-circle and of diameters adapted to snugly receive the cable ropes 35 and 36. The transversely-flanged outer ends of the ribs 106 are arcuately grooved as at 110, thereby providing outer water passageways 112 of lentil-shaped cross-section between the grooves 110 and the inner wall 114 of the elastomeric casing or hose 26. The grooves 108 are joined to and communicate with the central passageway 82 by radial passageways 116.

In the manufacture of the kickless water-cooled resistance welding cable 20 of the present invention, the tongues 62 and 88 of the adapters 60 and 86 of the respective terminal halves 38 and 40 are copper-welded into their respective recesses 64 and 90 of their respective terminal half bodies 58 and 84 by conventional copper-welding apparatus and techniques. The longitudinally-twisted stranded copper wire cable conductors 35 and 36 are pressed into their respective grooves 108 of the separator 34. The end portions 74 and 104 of the cable ropes 35 and 36 are then copper-welded into the sockets 72 and 94 of the bosses 68 and 92 of their respective adapters 60 and 86 in end to end engagement with the bottoms 76 and 95 of the sockets 72 and 94. The terminal halves 38 and 40, with their respective cable conductors 35 and 36 solidly copper-welded thereto, are now put together with their respective insulating strips 42 between them, and coupling bolts 48 inserted and tightened in the bolt holes 50, 52 and 54.

The assembly of the conductors 35 and 36 and separator 34 constituting the cable conductor unit 22 is now twisted longitudinally to cause the grooves 108 to constrict so that the ribs 106 tightly grip their respective conductor ropes 35 or 36. The elastomeric casing or hose 26 is then drawn over one of the terminals 24 and thence over the cable conductor unit 22 of the conductors 35 and 36, now in position in the separator 34, and thence onto the terminal 24 at the opposite end of the cable 20. The clamping rings 28 are then applied to the opposite ends of the hose or casing 26, constricting the elastomer thereof into the annular grooves 30 and providing a water-tight seal at the opposite ends of the hose 26 and terminals 24.

Thus, by the present invention there is provided a solid copper conducting path from one end of the welding cable to the other end thereof, uninterrupted by layers of solder and unaffected by the gaps which frequently occur between the end portions of the cable conductors and the bottoms of their respective cable conductor sockets employing such solders. As a result, the welding cable of the present invention has a much lower resistance and hence has a greatly improved current-carrying capability in comparison with former welding cables. Furthermore, because of the much higher melting point of copper than solder, it is much less likely to have its various joints disintegrate by melting than prior welding cables with solder-filled joints.

In the operation of the welding cable 20 of the present invention, the two terminals 24 at its opposite ends are bolted or otherwise connected respectively to the output terminals of a resistance welding transformer and the input terminals of a conventional welding gun. The cooling water ports 80 and 102 are likewise connected to a source of cooling water inlet and an outlet therefor. The welding gun is operated in the conventional manner while the cable 20 is cooled by cooling water passing through the central passageway 82 of the separator 34 and thence outward through the radial passageways 116 into the interstices between the hair-like copper wires of the stranded cable conductors or ropes 35 and 36 of the cable conductor unit 22. As the current ebbs and flows, the consequent pulsation causes the individual hair-like wires to move outward and inward, squeezing the water out and sucking it in so as to cool the heat arising in the cable 20 during operation. the squeezing effect of the concave grooves 108 of the ribs 106, because of the lengthwise twisting of the separator during assembly, tends to reduce the pulsations and consequently reduce the vibration and minimize the "kick" in the cable 20, which is already greatly reduced because of the alternating polarity arrangement of the cable conductors 35 and 36 (FIG. 8).

Due to the fact that the cable 20, except for its hose 26, insulator strip 42 and separator 34, is a solid uninterrupted mass of copper from one end of the cable to the other, without soldered joints, the efficiency of the cable 20 is maintained at a maximum and the resistance at a minimum.

I claim:

1. A water-cooled resistance welding cable with an uninterrupted copper welding current path, said cable comprising an elongated welding cable conductor assembly including a plurality of laterally-spaced flexible elongated stranded copper wire conductors of intended opposite electric polarities with an elongated separator of insulating material disposed therebetween and a flexible elongated tubular insulating casing surrounding said conductors, a terminal connected to each of the opposite ends of said conductor assembly, said terminal comprising a pair of copper terminal components disposed adjacent one another in laterally-spaced relationship and adapted to carry electric current of opposite polarities and connected to said conductors of the same intended electric polarities, and an insulator disposed in the space between said components, and copper-welded electrical connections disposed between the opposite end portions of said conductors and their respective terminal components.

2. A welding cable, according to claim 1, wherein each of said terminal components is of generally semicylindrical configuration with substantially flat sides facing one another, wherein said insulator member is a member of insulating material disposed in the space between said flat sides, and wherein each of said terminal components at one end thereof has a pair of welding cable conductor attachment portions with one pair of said attachment portions disposed between the other pair of attachment portions, said copper-welded connections being disposed between the ends of said conductors and the respective attachment portions of said terminal components.

3. A welding cable, according to claim 2, wherein said attachment portions comprise bosses disposed in coplanar pairs with the centers of said pairs disposed in planes approximately perpendicular to one another.

4. A welding cable, according to claim 2, wherein said attachment portions are of approximately sector-shaped cross-section.

5. A welding cable, according to claim 3, wherein said bosses contain sockets, and wherein said welded connections are disposed between the bottoms of said sockets and the end portions of their respective welding cable conductors.

6. A welding cable, according to claim 5, wherein said welded connections are also disposed between the side walls of said sockets and the end portions of their respective welding cable conductors.

7. A welding cable, according to claim 5, wherein the side walls of said bosses contain apertures therethrough disposed near said bottoms.

8. A welding cable, according to claim 1, wherein each of said terminal components includes an elongated copper body with a recess in one end portion thereof and also includes a copper adapter having a tongue thereon disposed in mating engagement with said recess, and wherein certain of said copper-welded connections are disposed between said tongue and said recess.

9. A welding cable, according to claim 1, wherein there are two pairs of said conductors, and wherein said separator is of cruciform cross-section with a central tubular core and with four ribs radiating therefrom and with concave side surfaces forming circularly-arcuate longitudinal grooves therealong, said conductors being seated in said grooves.

10. A welding cable, according to claim 9, wherein said core has a multiplicity of cooling liquid passageways extending transversely thereto into said grooves.

* * * * *